US005937732A

United States Patent [19]

Homann

[11] Patent Number: 5,937,732

[45] Date of Patent: Aug. 17, 1999

[54] ACTUATOR FOR CONVERTING FLUID ENERGY INTO A MECHANICAL FORCE

[76] Inventor: Werner Homann, Auweg 3, 82449, Uffing/Staffelsee, Germany

[21] Appl. No.: 08/950,924

[22] Filed: Oct. 15, 1997

[30] Foreign Application Priority Data

Oct. 22, 1996 [DE] Germany ..... 196 43 649
Jun. 17, 1997 [DE] Germany ..... 197 25 591

[51] Int. Cl.[6] ..... F01B 19/00

[52] U.S. Cl. ..... 92/43; 92/47; 92/92

[58] Field of Search ..... 92/30, 43, 47, 92/92, 93, 94

[56] References Cited

U.S. PATENT DOCUMENTS

| | | | |
|---|---|---|---|
| 3,645,173 | 2/1972 | Yarlott . | |
| 4,615,260 | 10/1986 | Takagi et al. . | |
| 4,819,547 | 4/1989 | Kukolj | 92/92 X |
| 5,018,506 | 5/1991 | Danna et al. | 92/92 X |
| 5,031,510 | 7/1991 | Krauter . | |
| 5,083,498 | 1/1992 | Sato et al. | 92/92 |
| 5,165,323 | 11/1992 | Sato . | |
| 5,201,262 | 4/1993 | Negishi et al. . | |
| 5,251,538 | 10/1993 | Smith | 92/92 X |
| 5,529,293 | 6/1996 | Haugs | 92/92 X |

FOREIGN PATENT DOCUMENTS

| | | | |
|---|---|---|---|
| 0 146 261 | 6/1985 | European Pat. Off. . | |
| 0 261 721 A3 | 3/1988 | European Pat. Off. . | |
| 1126745 | 3/1962 | Germany | 92/92 |
| 58-81205 | 5/1983 | Japan . | |
| 462 374 | 4/1967 | Switzerland . | |
| WO 86/03816 | 7/1988 | WIPO . | |

OTHER PUBLICATIONS

EP Search Report corresponding to EP 97 11 8235 dated Jan. 27, 1998.

*Primary Examiner*—Hoang Nguyen
*Attorney, Agent, or Firm*—Ratner & Prestia

[57] ABSTRACT

An actuator for converting fluid energy into a mechanical force comprises an inner expansion chamber and an outer power transmission envelope which surrounds the expansion chamber and comprises a flexible but non-stretchable endless filament or multifilament which is redirected with a back-and-forth motion between two tie rod members for surrounding the expansion chamber with multiple layers, the two tie rod members being connected with the two axial ends of the inner expansion chamber. By admitting a fluid into the expansion chamber for obtaining its radially outward directed expansion the two tie rod members will be approached with respect to each other by means of the power transmission envelope to thereby produce axially directed tension forces.

19 Claims, 2 Drawing Sheets

ACTUATOR FOR CONVERTING FLUID ENERGY INTO A MECHANICAL FORCE

TECHNICAL FIELD

The present invention relates to an actuator for converting fluid energy into a mechanical force.

BACKGROUND ART

EP 0 261 721 A3 discloses a hydraulically or alternatively pneumatically driven actuator of the before mentioned kind which comprises an inner substantially tubular expansion chamber of an elastic and resiliently deformable material which receives a substantially radially outward directed deformation under an inner pressure of the expansion chamber as imparted by an admission of fluid to the expansion chamber. This deformation of the expansion chamber is limited by an outer power transmission envelope which surrounds the expansion chamber and comprises a flexible but non-stretchable fiber material which is anchored at axial ends of the expansion chamber. When the expansion chamber is expanded in a radially outward direction under the inner fluid pressure the non-stretchable fiber material of the outer power transmission envelope then causes oppositely directed forces at the axial ends of the expansion chamber which are transmitted into axial tension forces.

With this known actuator the fiber material comprises monofilaments or multifilaments which are bundled as strings or as strands. These bundled monofilaments or multifilaments are combined for forming a network in which they are extending with opposite spirals under an inclination angle of about 50° to 80° in respect to the longitudinal axis of the expansion chamber. The network allows a relative angular displacement of the filaments at their crossings when the expansion chamber is radially expanded. Since the network is fixedly connected with tie rod members at axial ends of the expansion chamber which are arranged for the transmission of axial tension forces, this will result in an irregular conversion of the fluid energy into such mechanical forces.

STATEMENT OF THE INVENTION & ADVANTAGES

The object of the present invention is to provide an actuator of the kind as before described which precisely concentrates without any scattering the radially directed expansion of the expansion chamber as obtained by an imparted inner fluid pressure to the axis of the actuator so that the the fluid energy will be converted in an optimum manner to axial tension forces which may be used for driving purposes. The actuator according to the present invention incorporates the features of claim 1.

With an actuator in accordance with the inventive design the use of an endless filament as fiber material for the outer power transmission envelope will secure that the radial expansion of the expansion chamber receives a fully uniform distribution over the entire outer power transmission envelope even when the inner fluid pressure should be irregularly distributed over the length of the expansion chamber or if there should exist a locally different performance of the material. Such a different performance of the material especially exists at the fixing ends of the expansion chamber in relation to its center portion in particular during continuous operation of the actuator. Any local load peak will be balanced by the endless filament and such balance will be concentrated directly on the driving axis of the actuator through the positive connection of the tie rod members with the axial ends of the expansion chamber. The pressure energy as produced by the admission of a fluid into the expansion chamber will therefore be converted in an optimum manner into the axial tension forces which are used for the performance of the actuator. Such conversion takes place from the very beginning of the radial expansion of the expansion chamber due to the axially extending linear contact of the endless filament with the material of the expansion chamber as present over the entire outer surface of the same.

The use of an endless filament for the outer power transmission envelope further provides the advantage of a simple manufacturing process since the back-and-fro motion of the endless filament between the two axial tie rod members may be realized with simple mechanical equipment. Such back-and-fro motion of the endless filament will also allow in an equally simple manner to regulate the thickness of the multilayer envelope for the expansion chamber to thereby influence the amount of the mechanical force which is to be transmitted by the actuator in relation to the inner pressure as imparted by the fluid. This will further allow to guarantee a common safety factor for different outputs. As material for the endless filament there may be mainly considered synthetic fiber materials, such as for example aramide or PE fibers, carbon fibers, mixed fibers, etc., also as multifilaments or as strands.

The efficiency of the inventive actuator may be further improved by the measures that are claimed by the dependent claims.

When the expansion chamber will thusly be subdivided for example by slip-on annular members of an inelastic material this will then restrict the radial expansion of the expansion chamber and will enlarge the safety factor of the same. At the same time a larger degree of freedom will be obtained for the selection of the fiber material.

Dependent upon the working fluid which will be used and which could be compressed air or a different pressure gas and hydraulic oil or a different fluid medium it will also be allowable to influence the responsiveness and the clock time of the actuator as well as also the shortening of the working length of the actuator along its driving axis as obtained by the outer power transmission envelope and responsible for the amount of the mechanical force which is to be transmitted. The shortening of the working length of the actuator may for example be in the range of about 10 to 20%.

Concerning this particular value the same considers that the maximum shortening of the working length comprises a theoretical value of about 36%. If the shortening of the working length shall for example be in the range of about 10 to 20% then the responsiveness of the actuator may be further improved by the measure of filling the unused clearance volume of the expansion chamber in the range of about 90 to 80% with a floating core material which shall not participate in the expansion of the expansion chamber and which for this purpose could be centered by a spiral spring as connected with the tie rod members.

When for an alternative embodiment of the actuator the outer power transmission envelope will be surrounded by a cylinder spiral as connected at its ends with the two tie rod members for replacing said annular members there will then be obtained a fully uniform variation in size of the individual chambers that communicate which each other along the driving axis when the radial expansion of the expansion chamber will be imparted. The individual chambers will thereby receive an adaption to the lead or axial pitch of the cylinder spiral which when the inner pressure increases will itself adapt to the axial forces that are thereby obtained. The spiral running of the individual chambers accordingly changes steadily at an increase of the tension forces which therefore will be made more uniform correspondingly.

DRAWING

Further features and advantages of the inventive actuator may be derived from the following description of two embodiments as schematically illustrated in the drawing.

Figure 1:
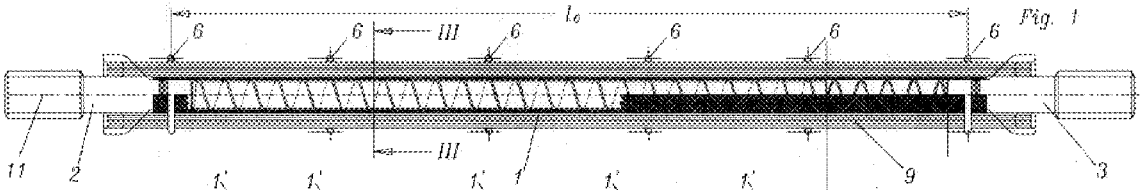
FIG. 1 is a partial sectional view of the actuator in accordance with a first embodiment and illustrating its starting position.

In the drawing two embodiments of an actuator are schematically illustrated each being adapted for converting fluid energy into a mechanical force. The supply source for the working fluid is not shown. As working fluid there will be used for example compressed air which at the working location of the actuator will be admitted via a connected supply line.

The actuator of FIGS. 1 to 5 comprises a tubular expansion chamber 1 which at its two ends is closed by the axial center part of two tie rod members 2 and 3. The two tie rod members 2, 3 are positively connected at 4 and 5 with the ends of the expansion chamber 1. The two positive connections 4, 5 are each obtained in such a manner that the respective end of the tube forming the expansion chamber receives a slip-on fit on an axial center part of the adjacent tie rod member 2, 3 followed by a multiple winding of a filament around such slip-on tubular end to such an extent that with the relevant pressure of the working fluid as imparted to the expansion chamber 1 the positive connections with the tie rod members 2, 3 will not be destroyed and the tightness of the expansion chamber 1 will be secured. The positive connections could also be replaced by non-positive connections at lower working pressures. The specific design could be also realized by different known measures.

Figure 2:
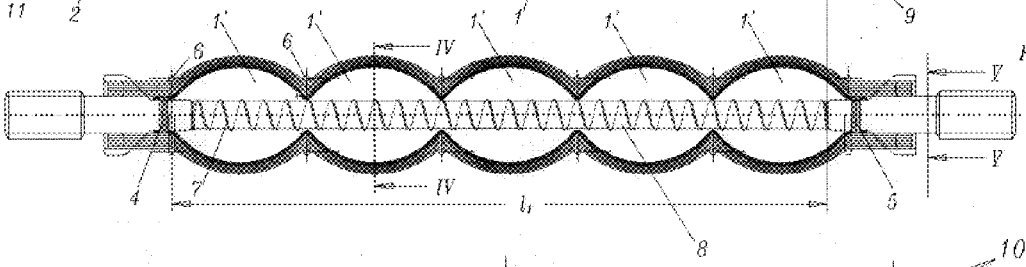
FIG. 2 shows the actuator of FIG. 1 in its working position.
Figure 3:
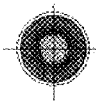
FIG. 3 is a cross-sectional view of the actuator along line III—III in FIG. 1.
Figure 4:
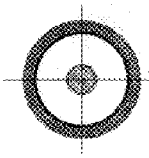
FIG. 4 is a cross-sectional view of the actuator along the line IV—IV in FIG. 2.
Figure 5:
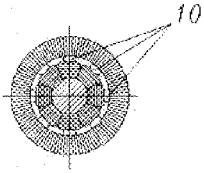
FIG. 5 is a cross-sectional view of the actuator along the line V—V in FIG. 2.

The expansion chamber 1 forms the actual actuating member of the actuator and comprises for this purpose an elastic, resiliently deformable material which receives a substantially radially outward directed deformation when compressed air or alternatively a different working fluid is admitted via one of the two tie rod members 2, 3 into the expansion chamber 1 to thereby impart an inner pressure against the inner wall of the same. This particular deformation is shown in FIG. 2 for such an embodiment of the actuator in which the expansion chamber 1 is subdivided into individual chambers 1' that communicate with each other and obtained by slip-on annular members 6 which are arranged in series along the length of the expansion chamber with mutually equal distances. The radial expansion of the individual chambers 1' is therefore limited to the axial space between such annular members 6. A spiral spring 7 is arranged inside of the expansion chamber 1 and connected with the two tie rod members 2, 3 for surrounding a core material 8 which is arranged floatingly inside of the expansion chamber 1. The core material 8 has no contact with the inner wall of the expansion chamber 1 in the starting position of the actuator as illustrated in FIG. 1. The spiral spring 7 centers the core material 8 within the expansion chamber 1 and secures its floating arrangement at the admission of the compressed air. Since the spiral spring 7 has a line contact with the inner wall of the expansion chamber, this will guarantee at the same time that the working fluid when supplied to the expansion chamber is uniformly distributed into all of its mutually communicating chambers so that the same will receive a common expansion. The core material 8 only takes over the passive task of filling clearance volume which when the expansion chamber 1 is supplied with working fluid for resiliently deforming and radially expanding the elastic material will not participate in such expansion. The initial working volume should be limited to a range of about 10 to 20% of the entire filling volume of the expansion chamber for guaranteeing a safe and economical working of the actuator.

The actuator is further completed by an outer power transmission envelope 9 which surrounds the expansion chamber 1 and comprises a flexible but non-stretchable fiber material. This fiber material comprises an endless filament which for surrounding the expansion chamber 1 with multiple layers is redirected with a back-and-fro motion between the two tie rod members 2 and 3. Such redirected or reciprocating motion of the endless filament is carried out over redirectional arms 10 which are radially disposed with respect to an axial center part of each tie rod member 2 and 3. For allowing a simple winding of the endless filament around such redirectional arms 10 as accordingly arranged in a star-like manner the two tie rod members 2 and 3 should be connected at their axial center part in such a manner with the ends of the expansion chamber 1 that the arms 10 of the one tie rod member 2 are circumferentially offset by the size of the gap between two arms with respect to the arms 10 of the second tie rod member 3. Such an arrangement secures at the same time that the outer power transmission envelope 9 as obtained with the endless filament comprises a compact and very dense package of filaments which will be maintained during the expansion of the mutually communicating chambers 1' as shown by the cross-sectional views of FIG. 3 and 4. Such a design therefore also secures that when the individual chambers 1' are expanded, the outer power transmission envelope 9 will then transmit a force that is precisely concentrated to the axis of the tie rod members 2 and 3 for achieving a shortening of the starting length $l_0$ to a working length $l_1$. This shortening results from a corresponding approach of the two tie rod members 2 and 3 along the common longitudinal axis 11 which on the other side produces axial tension forces due to the flexible but non-stretchable nature of the fiber material of the outer power transmission envelope 9. The pressure energy of the fluid which is admitted into the expansion chamber 1 is therefore converted into such axial tension forces. The longitudinal axis 11 establishes accordingly a relevant driving axis of the actuator which in this longitudinal axis 11 may be connected with an arbitrary actuating member. With a pneumatic design of the actuator a working pressure of for example about 8 bar will produce a tension force of about 6 kN whereby only about 10 to 20% initial working volume of the expansion chamber 1 will be provided.

Figure 6:
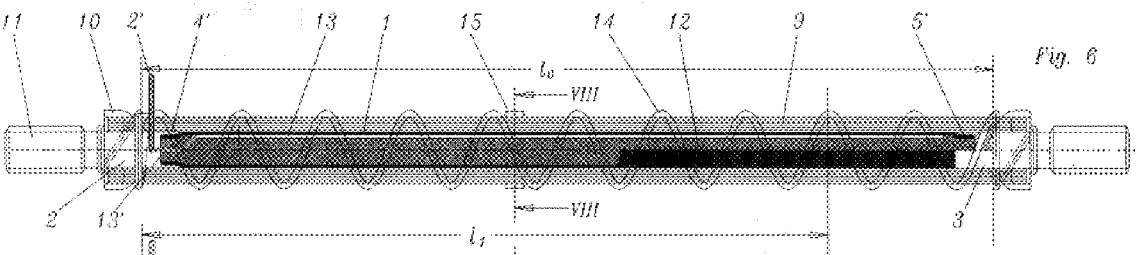
FIG. 6 is a partial sectional view of the actuator in accordance with a second embodiment and illustrating its starting position.
Figure 7:
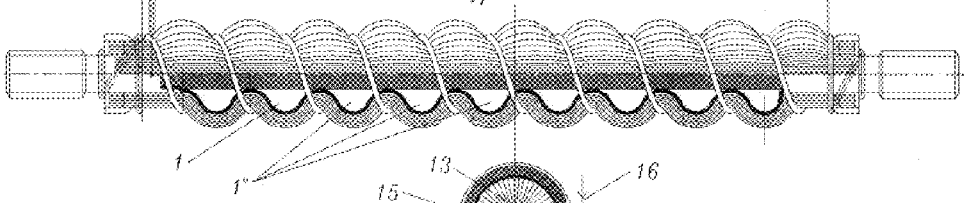
FIG. 7 shows the actuator of FIG. 6 in its working position.
Figure 8:
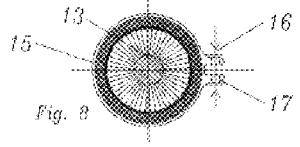
FIG. 8 is a cross-sectional view of the actuator along the line VIII—VIII in FIG. 6.

In the alternative second embodiment of the actuator as illustrated in FIGS. 6 to 8 the expansion chamber 1 is positively connected with corresponding tie rod members 2 and 3 together with a core material 12. The working fluid is admitted through a supply connection 2' at the one tie rod member 2 for the purpose of imparting an inner fluid pressure. A positive connection 4' is obtained with the one tie rod member 2 in such a manner that the adjacent axial ends of the expansion chamber 1 and of the core material 12 are fluid-tight interconnected and are press-fitted into an axial bore of an axial center part of the tie rod member 2 and bonded therein. A corresponding positive connection 5' is obtained with the second tie rod member 3 in such a manner that the expansion chamber 1 and the core material 12 are bonded at their faces with the face of the tie rod member 3.

This positive connection 5' may instead be formed in the same manner as the positive connection 4' and may therefore as well comprise an axial bore in the axial central part of the tie rod the tie rod member 3 into which the fluid-tight interconnected ends of the expansion chamber 1 and of the core material 12 are press-fitted and bonded therein.

The core material 12 comprises the same or at least substantially the same elastic, resiliently deformable material as the expansion chamber 1. In this embodiment no separate spiral spring is therefore used and the entire volume of the expansion chamber is instead filled with the core material so that its main length is in contact with the surrounding expansion chamber 1. The contact surface of the core material with respect to the surrounding expansion chamber is provided with a fluid channel with the design of at least one longitudinally extending groove 13 which with a center bore 13' at the end of the tie rod member 2 is connected with the connection 2' for the fluid supply of the actuator. When this fluid channel 13, 13' of the core material 12 is supplied with working fluid a substantially radially outward directed deformation of the expansion chamber 1 will be obtained which will then be transmitted to the outer power transmission envelope 9.

The power transmission envelope 9 comprises an endless filament which is redirected with a back-and-fro motion between the two tie rod members 2 and 3 for surrounding the expansion chamber 1 with multiple layers. Since the core material 12 in this case is arranged for completely contacting the expansion chamber 1 over its entire surface and since the core material 12 is also positively connected in common with the expansion chamber 1 at the axial ends thereof with the two tie rod members 2 and 3, this will allow a much easier winding operation of the endless filament when compared with the above described first embodiment.

For limiting the radial expansion of the expansion chamber 1 and for subdividing the same as well into mutually communicating individual chambers 1" the outer power transmission envelope 9 is in this case surrounded by an inelastic cylinder spiral 14 which is connected torsion-free with the two tie rod members 2, 3. During the radially directed deformation of the expansion chamber the mutually communicating chambers 1" of the expansion chamber 1 therefore will receive a spiral running along the driving axis 11 of the actuator as caused by the spiral windings of the cylinder spiral 14 which spiral running continuously follows the lead or axial pitch of the cylindrical spiral. The shortening of the starting length $l_0$ to a working length $l_1$ of the actuator will therefore result in even more uniform axial tension forces in the driving axis 11.

Instead of only one groove there may be also provided a plurality of longitudinally extending grooves for the core material 12 as uniformly distributed over its circumference to thereby achieve a more uniform expansion of the expansion chamber. The surface of the core material 12 may also be provided alternatively or additionally with slight slits running in parallel to the axis of the core material and being equally spaced over its circumference. Such slight slits will increasingly soften the core material when being compressed during the shortening of the actuator from its starting length $l_0$ to the working length $l_1$.

For obtaining a fine-adjustment of the axial tension forces when the actuator is in its working length $l_1$ a sleeve or collar 15 may be further provided. The collar 15 comprises an elastic, flexible material which surrounds the outer power transmission envelope 9 and is connected with two clamping jaws 17 that may be tightened against each other by means of tightening screws 16. When therefore the inner pressure of the working fluid radially expands the expansion chamber 1 to thereby mutually approach the two tie rod members 2, 3 by means of the outer power transmission envelope 9 then this collar 15 will follow the radial expansion of the one individual chamber 1" which is surrounded by the same until the working length $l_1$ has been reached. If the clamping jaws 17 are then tightened for shortening the surrounding length of the collar 15 this will decrease the opening size of the collar 15 and will create a counter-pressure that opposes the inner fluid pressure. This counter-pressure increases the actual working length of the actuator which then results in a fine-adjustment of the axial tension forces that before have been preset with the working length $l_1$ of the actuator.

We claim:

1. An actuator for converting fluid energy into a mechanical force, comprising an inner, substantially tubular expansion chamber of an elastic, resiliently deformable material which receives a substantially radially outward directed deformation under an inner pressure of the expansion chamber as imparted by an admission of a working fluid to the expansion chamber;

an outer power transmission envelope surrounding the inner, substantially tubular expansion chamber and comprising a flexible but non-stretchable fiber material which is anchored at both axial ends of the expansion chamber for performing axial tension forces when the expansion chamber is radially expanded;

said non-stretchable fiber material of the outer power transmission envelope comprising an endless filament or multifilament which for surrounding the expansion chamber with multiple layers is redirected with a back-and-fro motion between two tie rod members that are connected with the two axial ends of the expansion chamber.

2. An actuator according to claim 1, wherein each tie rod member comprises multiple redirectional arms that are arranged in a star-like formation as extending radially with respect to a center part through which axially directed tension forces are transmitted when the inner, substantially tubular expansion chamber is radially expanded, said multiple redirectional arms serving to redirect the endless filament or multifilament with a back-and-fro motion alternately and one after the other with respect to the individual redirectional arms of the two tie rod members.

3. An actuator according to claim 2, wherein the multiple redirectional arms of the tie rod member at one end of the inner expansion chamber are circumferentially offset with respect to gaps between a corresponding number of multiple redirectional arms of the tie rod member at the second end of the inner expansion chamber.

4. An actuator according to claim 2, wherein the axial ends of the inner expansion chamber are provided with a slip-on fit on axial center parts of the two tie rod members and are connected therewith in a fluid-tight manner.

5. An actuator according to claim 2, wherein the endless filament or multifilament of the outer power transmission envelope is redirected between the redirectional arms of the two tie rod members with such an initial back-and-fro motion as to obtain a line contact with the inner expansion chamber in parallel to its axis.

6. An actuator according to claim 1, wherein the endless filament or multifilament of the outer power transmission envelope is provided with a cast-on synthetic resin for its fixation on the two tie rod members.

7. An actuator according to claim 1, wherein the inner expansion chamber is subdivided into individual chambers mutually communicating with each other by means of inelastic annular bodies that surround the outer power transmission envelope with mutually equal distances along its axis whereby the radial expansion of the individual chambers is limited on the axial distances between axially successive annular bodies.

8. An actuator according to claim 1, wherein a spiral spring is arranged inside of the inner expansion chamber and connected to the two tie rod members for opposing the axial tension forces.

9. An actuator according to claim 1, wherein the inner expansion chamber comprises a floatingly arranged core material that is centered by a spiral spring whereby this core material reduces the fluid filling volume of the inner expansion chamber and does not participate in its radial expansion.

10. An actuator according to claim 9, wherein the core material fills out the initial fluid filling volume of the expansion chamber with at least about 65%, preferably in a range of about 80 to 90%.

11. An actuator according to claim 1, wherein the inner expansion chamber is subdivided into mutually communicating individual chambers by means of a cylinder spiral surrounding the outer power transmission envelope whereby the cylinder spiral is connected with its ends in a torsion-free manner with the two tie rod members for obtaining a spiral running of the individual chambers along the driving axis of the actuator that follows the lead or axial pitch of the cylinder spiral when the expansion chamber is radially expanded.

12. An actuator according to claim 11, wherein the outer power transmission envelope is surrounded by a collar at least at one of the individual chambers of the inner expansion chamber whereby the opening size of the collar may be changed for achieving a counter pressure with respect to the inner fluid pressure to thereby achieve a fine-adjustment of the axial tension forces that are present with the working length of the actuator.

13. An actuator according to claim 12, wherein the collar comprises an elastic, flexible material that surrounds the outer power transmission envelope and is connected with two clamping jaws which for increasing the counter pressure with respect to the inner fluid pressure may be tightened against each other by means of tightening screws.

14. An actuator according to claim 11, wherein the inner expansion chamber comprises a core material of the same or substantially same elastic, resiliently deformable material as the expansion chamber, the core material being fluid-tight connected at its axial ends with the inner expansion chamber and comprising a fluid channel which is connected to the fluid supply of the actuator and opens into the expansion chamber for imparting the inner fluid pressure.

15. An actuator according to claim 11, wherein the one tie rod member is provided with an axial bore in which the fluid-tight interconnecting ends of the inner expansion chamber and of the core material are fluid-tight press-fitted for being connected with the fluid supply of the actuator.

16. An actuator according to claim 14, wherein a main length of the core material fully contacts the surrounding inner expansion chamber, the fluid channel having at least one bore connected with the fluid supply of the actuator and having an orifice in the surface of the core material.

17. An actuator according to claim 14, wherein the core material is provided in its surface with axially extending slight slits.

18. An actuator for converting fluid energy into a mechanical force, said actuator comprising:

an inner, substantially tubular expansion chamber of an elastic, resiliently deformable material which receives a substantially radially outward directed deformation under an inner pressure of said expansion chamber as imparted by an admission of a working fluid to said expansion chamber; and an outer power transmission envelope surrounding said inner, substantially tubular expansion chamber and comprising a flexible but non-stretchable fiber material which is anchored at both axial ends of said expansion chamber for performing axial tension forces when said expansion chamber is radially expanded;

wherein said fiber material of said outer power transmission envelop is anchored so as to obtain line contact with said expansion chamber in parallel to its axis.

19. An actuator for converting fluid energy into a mechanical force, said actuator comprising:

an inner, substantially tubular expansion chamber of an elastic, resiliently deformable material which receives a substantially radially outward directed deformation under an inner pressure of said expansion chamber as imparted by an admission of a working fluid to said expansion chamber; and an outer power transmission envelope surrounding said inner, substantially tubular expansion chamber and comprising a flexible but non-stretchable fiber material which is anchored at both axial ends of said expansion chamber for performing axial tension forces when said expansion chamber is radially expanded;

wherein said non-stretchable fiber material of said outer power transmission envelope comprises an endless filament or multifilament having initially a line contact with said expansion chamber in parallel to its axis and surrounding said expansion chamber with multiple layers as redirected with a back-and-fro motion between two tie rod members that are connected with the two axial ends of said expansion chamber, and wherein said power transmission envelope provides a substantially tubular enclosure for said expansion chamber.

* * * * *